US006899251B2

(12) United States Patent
Christensen et al.

(10) Patent No.: US 6,899,251 B2
(45) Date of Patent: May 31, 2005

(54) GRAVITY-FEED DISPENSER AND METHOD OF DISPENSING INTER-FOLDED NAPKINS

(75) Inventors: James B. Christensen, Green Bay, WI (US); John R. Moody, Neenah, WI (US)

(73) Assignee: Fort James Corporation, Atlanta, GA (US)

( * ) Notice: Subject to any disclaimer, the term of this patent is extended or adjusted under 35 U.S.C. 154(b) by 133 days.

(21) Appl. No.: 10/213,575

(22) Filed: Aug. 7, 2002

(65) Prior Publication Data

US 2003/0062375 A1 Apr. 3, 2003

Related U.S. Application Data

(60) Provisional application No. 60/325,618, filed on Sep. 28, 2001.

(51) Int. Cl.[7] ..... A47K 10/24

(52) U.S. Cl. ..... 221/53; 221/45; 221/47; 221/48

(58) Field of Search ..... 221/45, 47, 48, 221/53, 63

(56) References Cited

U.S. PATENT DOCUMENTS

| | | | | | |
|---|---|---|---|---|---|
| 404,622 | A | * | 6/1889 | Hicks | 221/48 |
| 1,563,867 | A | * | 12/1925 | Krueger | 221/48 |
| 1,684,188 | A | * | 9/1928 | Merrin | 221/45 |
| 1,696,556 | A | * | 12/1928 | Schofer | 221/45 |
| 2,203,494 | A | * | 6/1940 | Greenhill | 221/45 |
| 3,269,592 | A | * | 8/1966 | Slye et al. | 221/44 |
| 3,754,681 | A | * | 8/1973 | Slye et al. | 221/45 |
| 3,935,965 | A | * | 2/1976 | Stevens | 221/48 |
| 4,065,028 | A | | 12/1977 | Merila | 221/36 |
| 4,094,442 | A | | 6/1978 | Radek | 221/58 |
| 4,311,252 | A | | 1/1982 | Hope, Jr. et al. | 221/63 |
| 4,343,415 | A | | 8/1982 | Radek | 221/63 |
| 4,679,703 | A | | 7/1987 | De Luca | 221/52 |
| 4,838,454 | A | | 6/1989 | Salzmann et al. | 221/52 |
| 4,877,154 | A | * | 10/1989 | Matsui | 221/48 |
| 4,951,837 | A | * | 8/1990 | Lentsch | 221/45 |
| 5,065,895 | A | | 11/1991 | De Luca et al. | 221/54 |
| 5,090,592 | A | * | 2/1992 | Petterson et al. | 221/55 |
| 5,100,020 | A | * | 3/1992 | Petterson et al. | 221/45 |
| 5,102,007 | A | * | 4/1992 | Petterson et al. | 221/6 |
| 5,219,092 | A | * | 6/1993 | Morand | 221/53 |
| 5,950,863 | A | | 9/1999 | Schutz et al. | 221/46 |

(Continued)

FOREIGN PATENT DOCUMENTS

| | | | |
|---|---|---|---|
| EP | 0555 577 A1 | 8/1993 | A47K/10/42 |
| WO | WO 97/09918 | 3/1997 | A47K/10/42 |
| WO | WO 98/22009 | 5/1998 | A47K/10/41 |
| WO | WO 02/051294 A2 | 7/2002 | |

*Primary Examiner*—Donald P. Walsh
*Assistant Examiner*—Matthew J. Kohner
(74) *Attorney, Agent, or Firm*—Michael W. Ferrell

(57) ABSTRACT

A gravity-feed dispenser for a stack of sheets such as inter-folded napkins includes a generally rectangular housing provided with a front wall, a back wall, two sidewalls and a lower portion as well as a funnel portion coupled to the lower portion of the housing provided with a generally convergent profile such that a front wall of the funnel portion extends downwardly and inwardly with respect to the front wall of the housing, a rear wall of the funnel portion extends downwardly and inwardly with respect to the rear wall of the housing and two sidewalls of the funnel portion extend downwardly substantially in alignment with the sidewalls of the housing. A dispensing aperture defined by the funnel portion of the dispenser has an elongate portion extending substantially from one sidewall of the funnel portion to the other sidewall of the funnel portion thus defining an elongate axis of the aperture. The elongate axis of the aperture is generally parallel to the front wall of the housing as well as generally parallel to its rear border. The aperture is configured so that the elongate portion thereof extends upwardly from its rear border to the front wall of the funnel portion of the dispenser such that folded absorbent sheets are presented at the front of the dispenser.

49 Claims, 10 Drawing Sheets

U.S. PATENT DOCUMENTS

| | | | | | |
|---|---|---|---|---|---|
| 6,003,723 | A | | 12/1999 | Morand | 221/44 |
| 6,053,355 | A | * | 4/2000 | Rupp et al. | 221/45 |
| 6,315,155 | B1 | * | 11/2001 | Hubanks et al. | 221/63 |
| 6,378,726 | B1 | * | 4/2002 | Chan et al. | 221/51 |
| 6,422,416 | B1 | * | 7/2002 | Tramontina | 221/45 |
| 6,520,372 | B2 | * | 2/2003 | Phelps | 221/34 |
| 6,543,641 | B2 | * | 4/2003 | Hubanks et al. | 221/45 |
| 6,575,329 | B2 | * | 6/2003 | Clark | 221/45 |
| 6,779,683 | B2 | * | 8/2004 | Taylor et al. | 221/61 |
| 2002/0070228 | A1 | * | 6/2002 | Moody | 221/47 |
| 2002/0074340 | A1 | * | 6/2002 | Phelps | 221/45 |
| 2003/0057221 | A1 | * | 3/2003 | Guillemette et al. | 221/45 |

* cited by examiner

GRAVITY-FEED DISPENSER AND METHOD OF DISPENSING INTER-FOLDED NAPKINS

CLAIM FOR PRIORITY

This non-provisional application claims the benefit of the filing date of U.S. Provisional Patent Application Ser. No. 60/325,618, of the same title, filed Sep. 28, 2001.

TECHNICAL FIELD

The present invention relates generally to gravity-feed dispensers for folded sheets and in a preferred embodiment to a gravity-feed dispenser and method for dispensing inter-folded napkins.

BACKGROUND ART

Dispensers for inter-folded napkins are well known in the art. Typically such dispensers are spring-loaded dispensers as is shown for example in the U.S. Pat. No. 4,838,454 to Salzmann et al. There is shown in the '454 patent a napkin dispenser including a drawer which slides in and out of the housing and a push plate which also slides in the housing and is spring-biased to push the napkins forward. A pair of locks on the rear of the drawer in the preferred napkin dispenser pushes the plate forward when the drawer is open but pivot to release the push plate when the drawer is closed so the napkins are not pressed too tightly, even if napkins are overloaded in the drawer when it is open. U.S. Pat. No. 4,679,703 to De Luca discloses a napkin dispenser configured to reduce bunching at the dispensing opening in the napkin dispenser. A pair of pressure relief rods are provided along the upper and lower portions of the dispenser face plate to relieve pressure between the face plate and the center portion of the napkin stack. U.S. Pat. No. 4,343,415 to Radek shows a napkin dispenser designed for disposition on a restaurant table or counter housing a stack of paper napkins. The dispenser is in the form of a parallelepiped with a top axis opening for loading and removing napkins. The opening is generally rectangular or may taper slightly from one end to the other. A salient feature is that the edges of the opening extend outwardly providing a relatively narrow peripheral arcuate flange or lip around the opening, the effect of which is to lead a napkin gently outwardly without likelihood of damage to the exiting napkins. U.S. Pat. No. 4,311,252 to Hope, Jr. et al. discloses a large capacity elevator type napkin dispenser including an elongated supporting structure or cage composed of series of spaced rod-like vertical supports. A stack of folded napkins is supported on a pressure plate that is mounted on a carriage adapted to slide vertically within the cage. U.S. Pat. No. 4,094,442, also to Radek discloses a napkin dispenser provided with an aperture which is generally rectangular except for a concavely arcuate edge on one side from which the napkins are normally extracted. Two opposed sides of the opening normal to the arcuate edge are provided with a pair of relatively narrow spring-biased leaves resiliently extendable into the container to facilitate loading, the free edges of the leaves being longitudinally gently oblique and widening to the aforesaid arcuate edge. Each of the leaves has a longitudinal outwardly turned lip and the exposed comers of the leaves are rounded. The features are reported to contribute towards a convenient extraction of a napkin without damage.

There is shown in U.S. Pat. No. 4,065,028 to Merila a dispenser for paper napkins consisting of a housing adapted to support a stack of napkins in such a manner that a flap of the lowermost napkin depends downwardly in the housing by gravity and an ejector is mounted moveably in the housing and operable by reciprocation to engage the depending napkin flap and extend it outwardly through an opening of the housing where it may be grasped for removal from the housing.

In connection with gravity-feed dispensers, it is known to employ shelf members projecting inwardly into the housing. In this respect there is disclosed in U.S. Pat. No. 6,003,723 to Morand a dispenser for stacked single-fold towel sheets with a rear wall, sidewalls and front and rear funnel walls extending to a funnel height between bottom portions of the sidewalls on opposite sides of a feed slot and a pair of shelf members projecting downwardly and inwardly from respective ones of the sidewalls.

So also, in U.S. Pat. No. 5,219,092 likewise to Morand there is shown a dispenser for dispensing folded interleaved towels. The dispenser has front and back walls joined by sidewalls and a bottom wall with a central paper towel dispensing slot extending between the sidewalls. The dispenser has a support on the inner surfaces of the front and back walls for partially supporting sub-stacks of a stack of paper towels carried in the dispenser. The supports reduce the weight of towels carried by the bottom sub-stack of towels making it easier to dispense the towels.

U.S. Pat. No. 5,950,863 to Schutz et al. discloses an insert device for a sheet dispenser having a housing for receiving a stack of folded sheets, a bottom opening of the housing being formed as a rounded elongate slot having an enlarged center portion. The dispenser includes a rear panel portion, an inwardly and upwardly sloping front ramp portion and a pair of side panel portions connecting the front ramp to the rear panel and a ledge portion extending inwardly from the panel portion toward the ramp portion. There is noted in the '863 patent a plurality of ridges along the front ramp of the insert device.

From the foregoing references one of skill in the art will appreciate that long sought-after features in dispensers for absorbent sheet are that the dispensers dispense product without bunching or tearing of the napkins or towels and that the product is not released in "clumps" leading to excessive waste; since releasing too many sheets at a time will lead to sheets being discarded without ever having been used. A likewise sought-after characteristic for a dispenser for absorbent sheets is that the dispenser should dispense one sheet at a time. Various means have been employed to try to achieve this result, for example, a dispensing slot that is relatively narrow and is provided with a transverse slot to restart the stack in the event a tail no longer protrudes from the dispenser. Such apertures can be seen, for example, in PCT publication no. WO 97/09918 and PCT publication no. WO 98/22009.

Despite many advances in the art, there is still a need for a low-cost, reliable dispenser which can accommodate a large number of absorbent sheets and reliably dispense the sheets, preferably one sheet at a time, in response to a grasping/withdrawing motion of a user.

SUMMARY OF INVENTION

There is provided in accordance with the present invention a gravity-feed dispenser for dispensing a stack of folded absorbent sheets including: (a) a generally rectangular housing provided with a front wall, a rear wall, two sidewalls, and a lower portion; (b) a funnel portion coupled to the lower portion of the housing provided with a generally convergent profile such that the front wall of the funnel portion extends downwardly and inwardly with respect to the front wall of the housing, a rear wall of the funnel portion extends downwardly and inwardly with respect to the rear wall of the housing and two sidewalls of the funnel portion extend downwardly substantially in alignment with the sidewalls of the housing. The funnel portion may be integrally formed with the housing, or attached by way of tabs, rivets or the like. Likewise, the construction of the inventive dispenser may be made in sections of any suitable size and dimensions. A dispensing aperture is defined by the funnel portion of the dispenser, the aperture having an elongate portion extending substantially from one sidewall of the funnel portion to the other sidewall of the funnel portion thus defining an elongate axis of the aperture. The elongate axis of the aperture is generally parallel to the front wall of the housing and generally parallel to a rear border of the aperture. The aperture is configured so that the elongate portion extends upwardly from its rear border to the front wall of the funnel portion of the dispenser such that folded absorbent sheets disposed in the funnel portion of the dispenser are exposed adjacent the front wall of the funnel portion of the dispenser over a substantial height from the rear border of the elongate portion of the aperture and are so presented at the front of the dispenser.

A plurality of declivitous guide ridges disposed on an inner surface of the front wall of the funnel portion of the dispenser are configured to guide folded absorbent sheets downwardly as they are drawn through the aperture of the dispenser; whereas a plurality of subsidiary guide ridges disposed on an inner surface of the rear wall of the funnel portion of the dispenser are also configured to guide folded absorbent sheets downwardly as they are drawn through the aperture of the dispenser. The plurality of declivitous guide ridges and the plurality of subsidiary guide ridges are positioned, configured and dimensioned to incline sheets of the stack toward the front wall of the funnel portion of the dispenser with respect to a horizontal position of the sheets in the stack. There are further provided shelf means positioned about the terminal portions of the elongate portion of the aperture for supporting the stack of absorbent sheets within the dispenser. The dispenser may be made of any suitable material, such as metal or plastic. Plastic is particularly preferred for the funnel portion of the dispenser as will be readily appreciated by one of skill in the art.

In preferred embodiments the dispensing aperture is provided with an arcuate front lip extending upwardly to a maximum height at its central portion. The inventive dispenser is especially suitable for inter-folded napkins of suitable length; for example, the dispenser is suitable for napkins having a dispensing length of up to 10½ inches or so. More typically, suitably configured inter-folded napkins have a dispensing length of up to about 7½ inches. So also, in a preferred embodiment the declivitous guide ridges disposed on the inner surface of the front wall of the funnel portion extend upwardly to a height greater than a height that the subsidiary guide ridges project upwardly so as to incline the sheets in the dispenser towards the front of the funnel portion of the dispenser. The declivitous guide ridges may be provided with an arcuate profile; whereas the subsidiary guide ridges on the rear wall of the funnel portion of the dispenser may be provided with a generally triangular profile. Typically, the declivitous guide ridges project a maximum distance of from about ½ inch to about 1 inch. In a particularly preferred embodiment the declivitous guide ridges project from a maximum distance of about ¾ inch.

In a preferred aspect of the invention, the plurality of declivitous guide ridges include at least one centrally located declivitous guide ridge and at least a pair of laterally located declivitous guide ridges. The centrally located declivitous guide ridge projects upwardly to a height higher than the laterally located declivitous guide ridges. In such embodiments, two centrally located declivitous guide ridges are preferred, each of which projects upwardly to a height higher than the laterally located declivitous guide ridges of the front wall of the funnel portion of the dispenser.

In general, the subsidiary guide ridges project from the rear wall of the funnel portion of the dispenser a maximum distance of less than of the maximum distance the declivitous guide ridges project from the front wall. Typically, the subsidiary guide ridges project from the rear wall of the funnel portion a maximum distance of from about ¼ inch to about ½ inch therefrom. T subsidiary guide ridges may project from the rear wall of the funnel portion of the dispenser a maximum distance of about ⅜ of an inch in a preferred embodiment.

The shelf means on the sidewall about the terminal portions of the dispenser provide needed support, particularly when the stack of napkins being dispensed is depleted. The shelf means may comprise a plurality of generally rectangular projections projecting inwardly from the sidewalls of the funnel portion of the dispenser defining a shelf height above the elongate axis of the aperture.

The guide ridges and the generally rectangular projections of the shelves may have friction surfaces having a friction surface width of from about 40 to about 100 mils (thousandths of an inch). From about 50 to about 70 mils is typical. A slightly larger width may be employed with respect to the shelf supports about the terminal portions of the elongate portion of the dispensing aperture if so desired.

Typically the plurality of declivitous guide ridges consists of from 2 to 8 declivitous guide ridges and may include at least 4 declivitous guide ridges in a preferred embodiment. Likewise, the plurality of subsidiary guide ridges on the rear wall of the funnel portion of the dispenser typically includes from 2 to 8 subsidiary guide ridges with at least about 4 subsidiary guide ridges in a preferred embodiment.

As noted above, the gravity-feed napkin dispenser of the present invention is particularly adapted in a preferred embodiment to dispense a stack of inter-folded napkins. Such inter-folded napkins may be a stack of single-fold inter-folded napkins or a stack, for example, of two-fold inter-folded napkins. In some embodiments, the absorbent sheet to be dispensed may have more than two folds or may not include inter-folded sheets.

The length of the elongate axis of the dispensing aperture is generally from about 5 to about 20% less than the corresponding dispensing length of the stack of folded absorbent sheets; and is typically about 10% less than the corresponding dispensing length of the stack of folded absorbent sheets that are dispensed.

In a preferred embodiment the dispensing aperture further includes a transverse portion extending from the base of the elongate portion of the aperture upwardly in the rear wall of the funnel portion of the dispenser, the transverse portion of the aperture being configured to allow access to the interior of the funnel portion of the dispenser in order to withdraw absorbent sheet from the dispenser. This feature is provided so that a user may restart the stack if the tail is lost during dispensing. This feature is particularly important when dispensing inter-folded napkins in that, from time to time, the tail of a following napkin may fail to be drawn through the dispensing slot when a napkin is withdrawn. In such cases a user may insert a finger in the slot towards the rear of the dispenser in order to remove a napkin. However, if a tail is presented to a user, the transverse portion of the slot will remain substantially hidden from the user and will not be employed to withdraw multiple napkins from the stack leading to excess waste. Typically, the transverse portion of the dispensing aperture has a width from about 1½ to about 2½ inches and has a width of about 2 inches in a preferred embodiment. The transverse portion of the dispensing aperture has a length of from about 3 to about 4 inches from the opposed lip of the elongate portion of the dispensing aperture. That length, in a preferred embodiment, is about 3½ inches. Generally, it is desirable that the transverse portion of the dispensing aperture extends upwardly in a central portion of the rear wall of the funnel portion of the dispenser.

In another aspect of the present invention a method of dispensing a stack of inter-folded napkins includes disposing a stack of inter-folded napkins in a dispenser configured as recited above and withdrawing the napkins through the dispensing aperture. The method may further include the step of preparing a stack of inter-folded napkins provided with an indicator identifying a front portion thereof and then disposing the stack of napkins in the dispenser with the front portion thereof adjacent the front wall of the dispenser. This particular aspect of the invention is especially convenient for multi-fold or two-fold inter-folded napkins wherein each napkin has a lower tail portion projecting in the same direction with respect to the stack and it is desired to have those lower tail portions project toward the front wall of the housing so as to be readily accessible. These and other features of the present invention are illustrated in the accompanying drawings, and are further described in the text which follows.

BRIEF DESCRIPTION OF DRAWINGS

The invention is described in detail below in connection with the various figures wherein like numerals indicate like parts and wherein.

DETAILED DESCRIPTION

Figure 1:
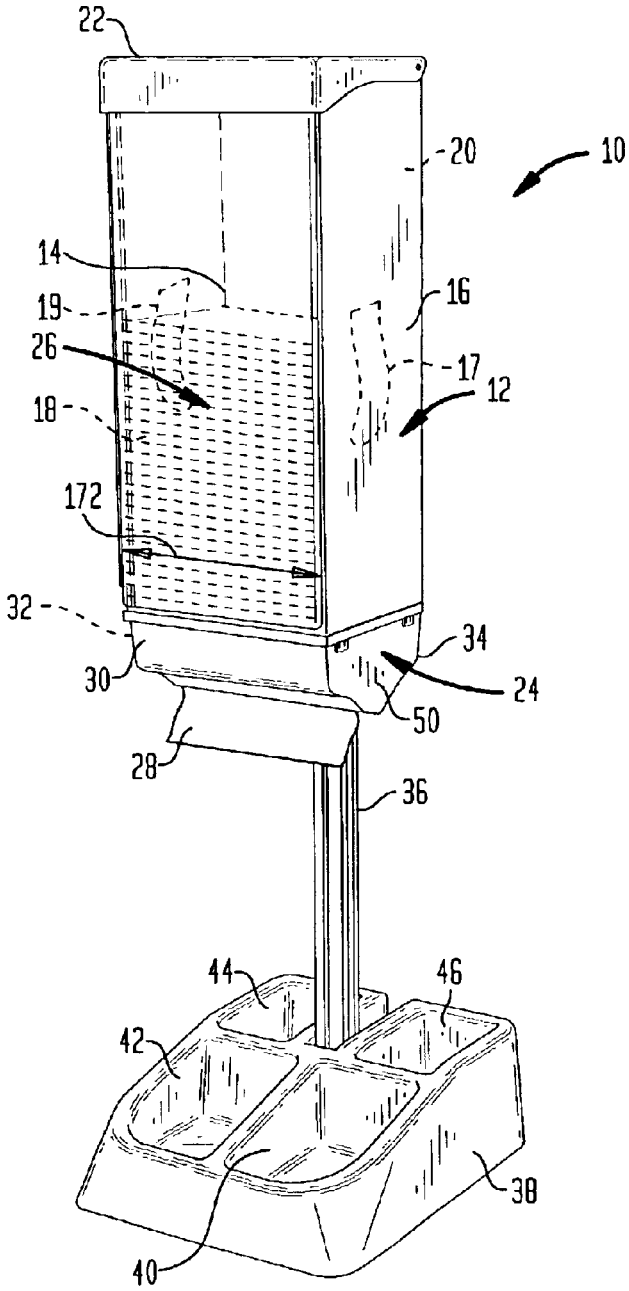
FIG. 1 is a view in perspective of an inventive napkin dispenser constructed in accordance with the present invention.
Figure 2:
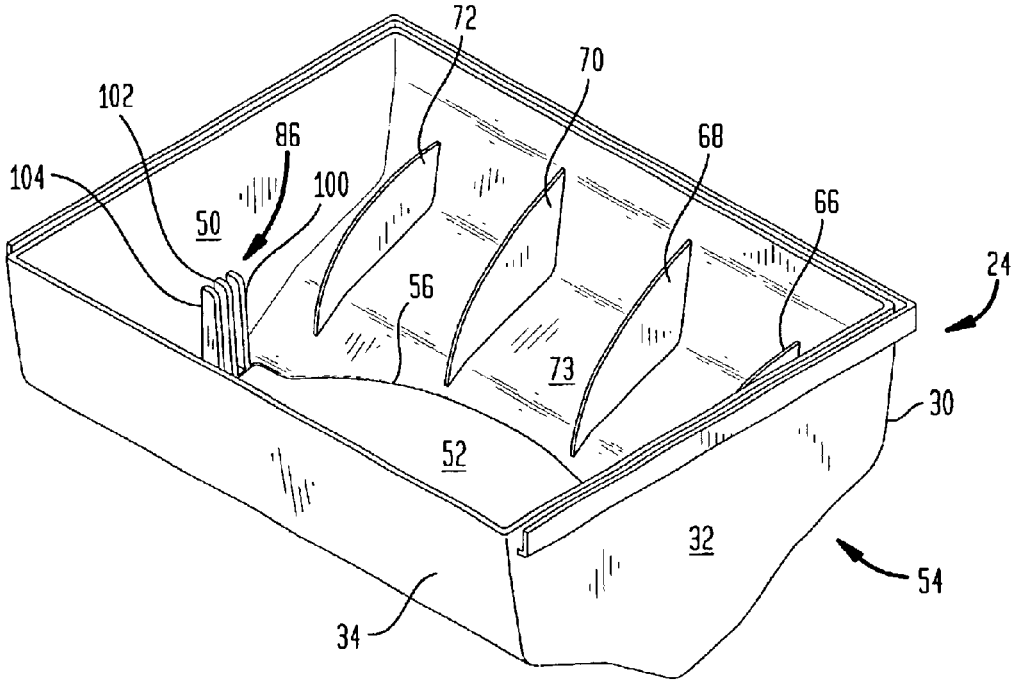
FIG. 2 is an enlarged view in perspective of a portion of the interior of the funnel portion of the dispenser of FIG. 1.

The invention is described in detail below in connection with the various figures. Such description and illustration is for purposes of exemplification only; modifications within the spirit and scope of the present invention will be readily apparent to those of skill in the art. The spirit and scope of the invention is set forth in the appended claims hereto.

Referring to FIGS. 1 through 8, there is shown a gravity-feed dispenser 10 for a stack of folded absorbent sheets which includes a housing 12 including a door 14 which operates as a front wall, a sidewall 16, another sidewall 18 and a rear wall 20. Dispenser 10 is provided with a top 22 hinged onto housing 12. The housing portion of the dispenser is attached to a lower funnel portion 24 which may be bolted or otherwise secured to rectangular housing 12 or, the various pieces may be formed in any suitably sized sections as will be appreciated by one of skill in the art. The dispenser as shown in FIGS. 1 through 8 is particularly adapted to receive a stack of inter-folded napkins 26 which are dispensed through an aperture such that the tail of an inter-folded napkin preferably protrudes through the aperture as shown at 28 in FIG. 1. The lower funnel portion of the dispenser generally has a convergent profile as will be appreciated from the discussion hereafter wherein a front wall 30 extends downwardly and inwardly towards a back wall 34 which also extends downwardly and inwardly. The dispenser may be mounted on a mounting post such as post 36 which is secured in a base 38. The base is optionally provided with a plurality of compartments 40–46 for receiving condiments for example such as salt, pepper, ketchup and mustard. There is optionally provided a pair of supports, 17 and 19, which protrude into the interior of the housing to support the stack.

Door 14 and top 22 are preferably hinged to the remainder of the housing to facilitate loading and unloading of absorbent sheets.

The various features of the lower portion of inventive dispenser 10 are perhaps best appreciated by reference to FIGS. 2 through 8.

Funnel portion 24 includes a front wall 30 and rear wall or back wall 34 as well as funnel sidewalls 32 and 50. Sidewall 32 is essentially coextensive with sidewall 18 of housing 12, whereas sidewall 50 is essentially coextensive with sidewall 16 of housing 12 as shown particularly in FIG. 1. Front wall 30, however, extends downwardly and inwardly with respect to door 14 and rear wall 34 likewise extends downwardly and inwardly with respect to back wall 20 as will be appreciated from the various figures. The lower or funnel portion of the dispenser thus exhibits the convergent profile 54 perhaps best seen in FIG. 7. The various parts of funnel portion 24 define a dispensing aperture 52 which is seen from various views and details in FIGS. 2 through 8. Aperture 52 includes an elongate portion 56 extending substantially between sidewall 32 and sidewall 50. Elongate portion 56 of aperture 52 thus defines an elongate axis 58 of the aperture which generally bisects elongate portion 56 of the aperture along its length. The elongate axis is generally parallel to the front wall or door 14. The aperture is likewise provided with a rear border 59. The aperture is generally configured so that the elongate portion extends upwardly from its rear border 59 a substantial height 60 (typically ½ inch or so) to front wall 30 of the funnel portion such that folded sheets disposed in the funnel portion of the dispenser are exposed adjacent the front wall of the dispenser over a substantial height from the rear border of the aperture and so are presented to the front of the dispenser to a user. That is to say, the aperture is generally angled forward toward the front of the dispenser.

Aperture 52 is further provided with a transverse portion 62 extending from a front lip at 64 of the elongate portion of the aperture upwardly in rear wall 34 of the funnel portion wherein transverse portion 62 is configured to allow access to the interior of funnel portion 24 of dispenser 10 in order to withdraw absorbent sheet for the user from the dispenser. The transverse portion is located at the rear of the dispenser so that a user will only be motivated to utilize the slot to insert a finger to restart a stack of inter-folded napkins, for example, when the tail of the lead napkin is not protruding through the slot. There is further provided a plurality of declivitous guide ridges such as ridges 66, 68, 70, and 72 protruding upwardly from an inner surface 73 of front wall 30 configured to guide folded absorbent sheets downwardly as they are drawn through aperture 52. A plurality of subsidiary guide ridges such as ridges 74, 76, 78 and 80 disposed on an inner surface 75 of rear wall 34 of funnel portion 24 are also configured to guide the folded sheets downwardly as they are drawn through the aperture of the dispenser. The declivitous guide ridges and the subsidiary guide ridges are positioned, configured and dimensioned to incline sheets of the stack in the direction of inclination toward the front wall of the funnel portion of the dispenser with respect to a horizontal position of the sheets in the stack as is perhaps best appreciated by reference to FIG. 11 discussed hereinafter. A pair of shelf means, 84 and 86 made up of three generally rectangular ridges each are disposed in the funnel portion about the terminal portions 90 and 92 of elongate portion 56 of aperture 52 in order to support the stack of sheets in the dispenser, particularly when the stack is depleted. Shelf means 84 comprise rectangular support members 94, 96 and 98 which project inwardly into the interior of the funnel portion whereas shelf means 86 includes generally rectangular members 100, 102 and 104 which also project inwardly into the interior of the funnel portion of the dispenser.

Figure 5:
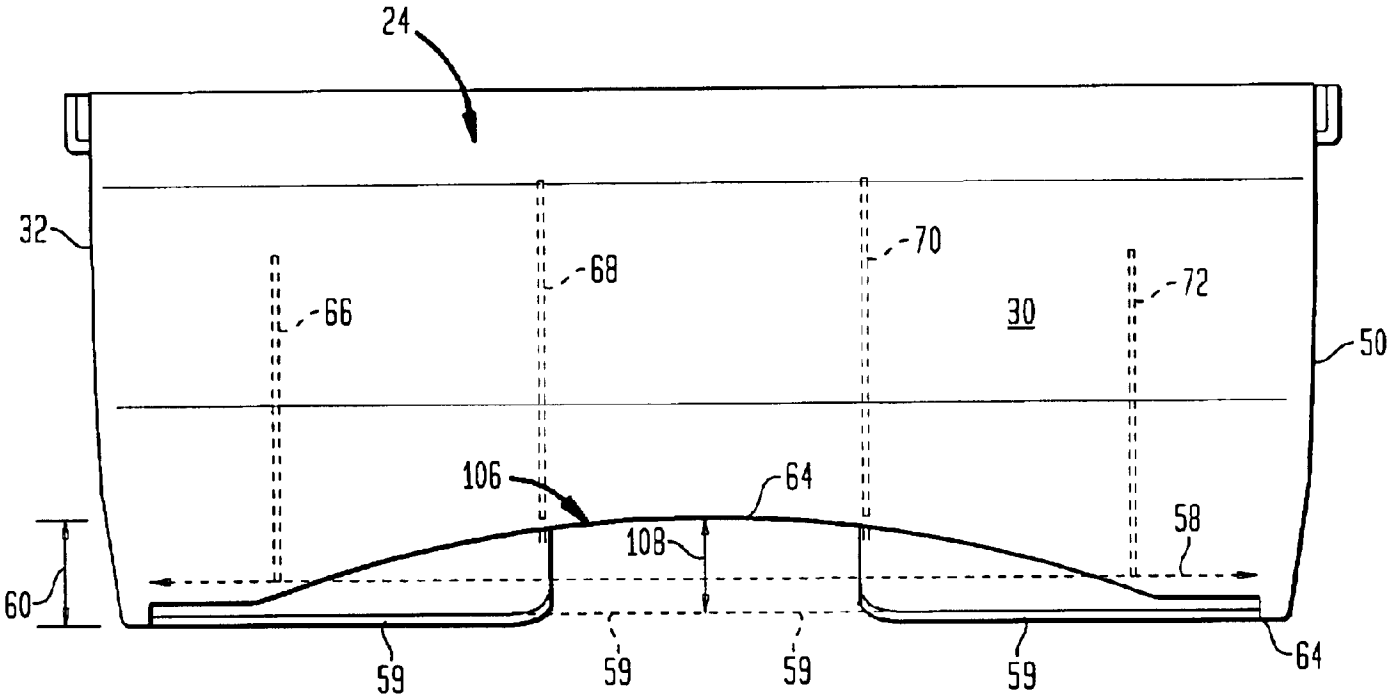
FIG. 5 is a view from the front in elevation of the funnel portion of the napkin dispenser shown in FIG. 2.
Figure 7:
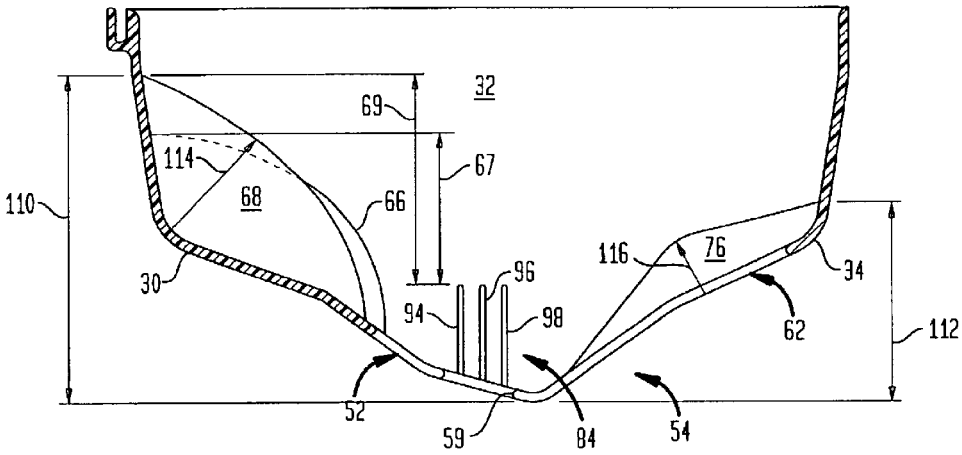
FIG. 7 is a view in elevation and partial section of the funnel portion of the napkin dispenser shown in FIG. 2.
Figure 8:
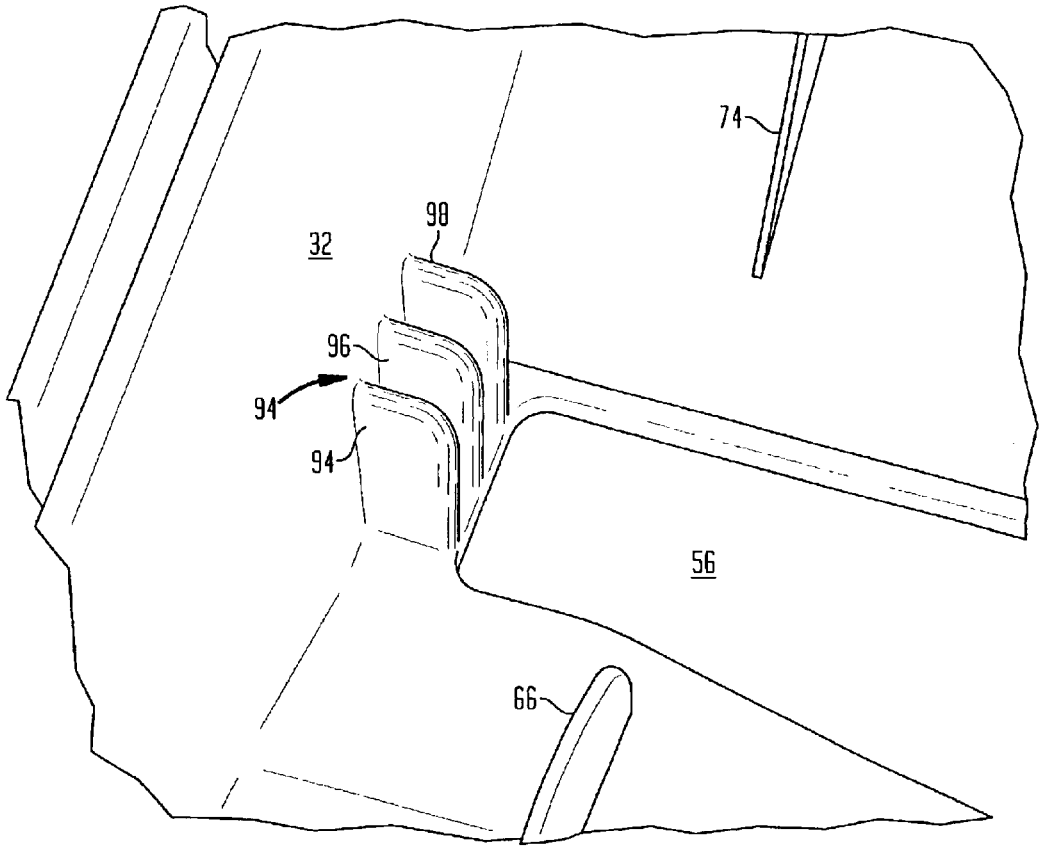
FIG. 8 is an enlarged detail of the funnel portion of dispenser shown in FIG. 2 illustrating the location of the various guide ridges and shelf supports about the dispensing aperture.

In a preferred embodiment dispensing aperture 52 is provided with an arcuate front lip 106 which extends upwardly to a maximum height 108 at its central portion as can be seen particularly in FIG. 5. Height 108 may be bout ½ inch in height from rear border 59. In typical embodiments the declivitous guide ridges disposed on the inner surface of the front wall of the funnel portion extend upwardly to a maximum height 110 for example, which is higher than the height 112 of the subsidiary guide ridges on the opposite side of the dispensing aperture. This geometry tends to incline the napkin stack toward the front of the dispenser as will be appreciated from FIG. 11. Generally speaking, the declivitous guide ridges are provided with an arcuate profile in a preferred embodiment as can be seen in FIG. 7. Most preferably, the declivitous guide ridges are configured so that the centrally located declivitous guide ridges project upwardly higher than the laterally located declivitous guide ridges. This geometry is believed to relieve pressure on the shelf means so that napkins being dispensed, for example, do not bind or tear in the dispenser. Thus, declivitous guide ridges 66 and 72 may project upwardly a height 67 of 1.1 inches or so from shelf 84 while declivitous guide ridges 68 and 70 may project upwardly a height 69 of 1.5 inches or so from shelf 84 for a dispenser with a six-inch aperture for dispensing napkins with a 6½ inch dispensing length.

The subsidiary ridges are provided with a generally triangular profile in the embodiment illustrated. The declivitous guide ridges project from the front wall of the funnel portion of the dispenser a maximum distance 114 of from about ½ to about 1 inch and typically a maximum distance 114 of about ¾ inch. The subsidiary guide ridges project from the rear wall of the funnel portion of the dispenser a maximum distance 116 of from about ¼ to about ½ inch. Typically the subsidiary guide ridges project from rear wall 34 of said dispenser a maximum distance 116 of about ⅜ of an inch.

Whereas the shelf means may comprise a plurality of rectangular projections projecting inwardly from the sidewalls at the funnel portion of the dispenser, any suitable shelf may be employed so long as it prevents excess sheets from falling through the dispenser.

Declivitous guide ridges have friction surfaces such as surfaces 118 and 120 which have a friction surface width 122 of typically from about 40 to about 100 thousandths of an inch (mls). Typically the width 122 of the guide ridges is from about 50 to 70 mls. Likewise, the subsidiary guide ridges have friction surfaces 124, 126, for example, which have a width 130 of likewise from about 40 to about 100 mls. Typically however the width 130 of the subsidiary ridges is also from about 50 to about 70 mls.

As noted above the inventive dispenser as shown in the figures is particularly adapted for a stack of inter-folded napkins. Such napkins are well known in the art as is shown for example in FIG. 9 which illustrates the geometry of a stack of inter-folded, single-fold, napkins.

Figure 9:
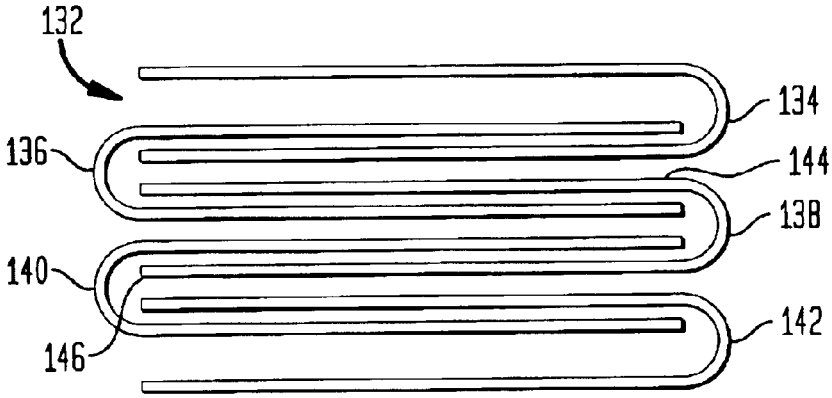
FIG. 9 is a schematic diagram illustrating a single-fold geometry for a stack of inter-folded napkins.

A stack geometry 132 as shown in FIG. 9 includes a plurality of inter-folded napkins 134, 136, 138, 140 and 142, for example, each of which has a single-fold and is thus divided in two equal panels. For example napkin 138 has an upper panel 144 and a lower panel 146 as will be appreciated by one of skill in the art. Such napkins are readily dispensed in the inventive dispenser one at a time as is further described herein.

Figure 10:
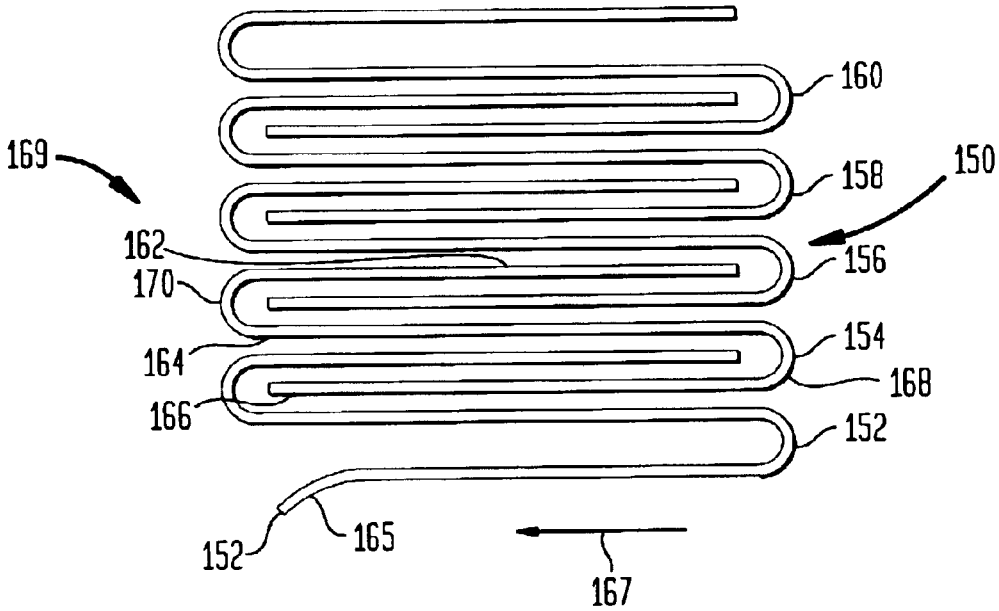
FIG. 10 is a schematic diagram illustrating the geometry of a stack of two-fold inter-folded napkins.

An alternate fold geometry 150 is shown in FIG. 10 wherein there is provided a plurality of napkins in a stack such as napkins 152, 154, 156, 158 and 160 wherein each napkin is provided with two folds and has three equal panels. For example, napkin 154 has an upper panel 162, an intermediate panel 164 and a lower panel 166. Moreover, each napkin such as 154 is provided with two folds, one at 168 and yet another at 170 as is shown in FIG. 10. Unlike the single-fold napkins, the two-fold inter-folded napkins of FIG. 10 always present their "tail" such as tail 165 of napkin 172 in the same direction with respect to the stack as they are dispensed; for example, the lower panel 166 of napkin 154 will be presented in the same direction 167 of tail 165 after napkin 152 is withdrawn from the bottom of the stack in a dispenser such as dispenser 10 of FIG. 1 and following. Packages or bundles of such napkins are preferably marked with an arrow, such as arrow 167, pointing in the direction of front 169 of the stack. The stack is placed in the dispenser so that front 169 faces front wall 30 of funnel portion 24 so that the tails of the napkins always project toward the front of the dispenser and are conveniently presented to the consumer.

Figure 3:
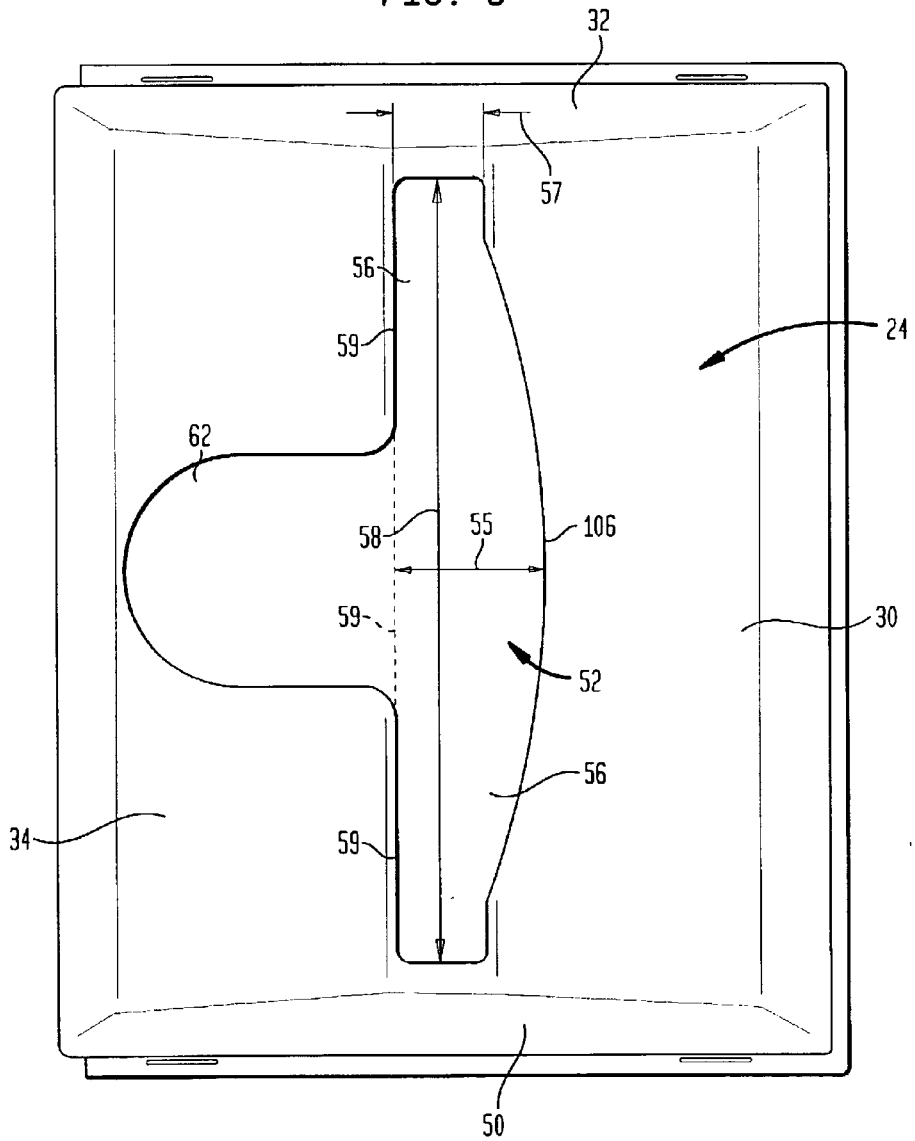
FIG. 3 is a bottom plan view of the funnel portion of the dispenser shown in FIG. 2.
Figure 4:
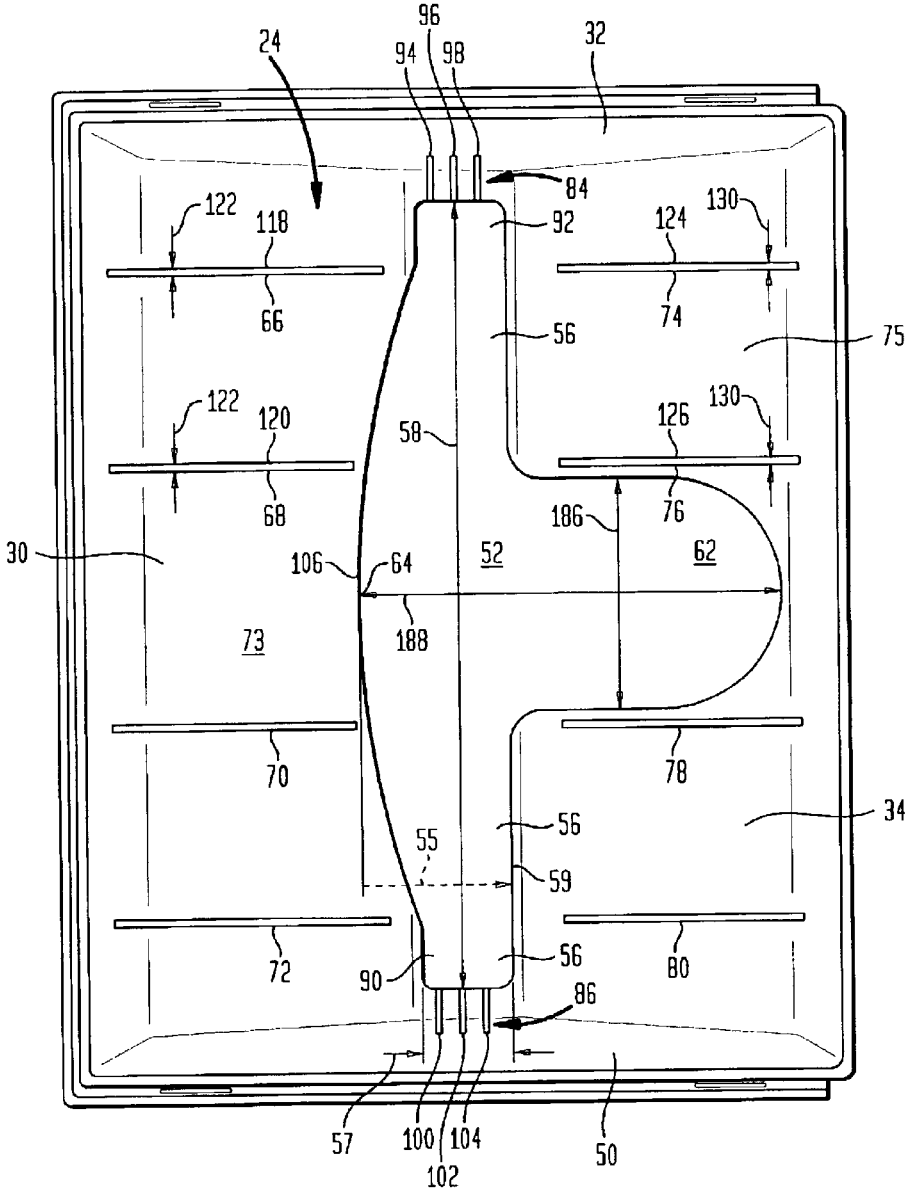
FIG. 4 is a top plan view of the inside of the funnel portion shown in FIG. 2.

One may utilize the fold geometry of FIG. 9 or 10 in connection with the napkin dispenser shown in the dispenser shown in FIGS. 1 though 8. That is to say stack 26 may have the geometry of either FIG. 9 or 10. Typically the length of elongate axis 58 of the dispensing aperture is slightly shorter than the corresponding dispensing length indicated at 172 of the folded sheet to be dispensed. In a typical embodiment the elongate portion 56 of the aperture is about 10% shorter than the dispensing length of the folded sheet. For example if a 6½ inch long folded sheet is desired to be dispensed the elongate axis 58 and thus the length of elongate portion 56 of the dispensing aperture would be about 6 inches. In such an embodiment, elongate portion 56 of aperture 52 may have a maximum transverse width 55 of about an inch or so at its center portion and a minimum width 57 of about ½ to ¾ of an inch or so at its terminal portions as can be seen in FIG. 3.

Figure 11:
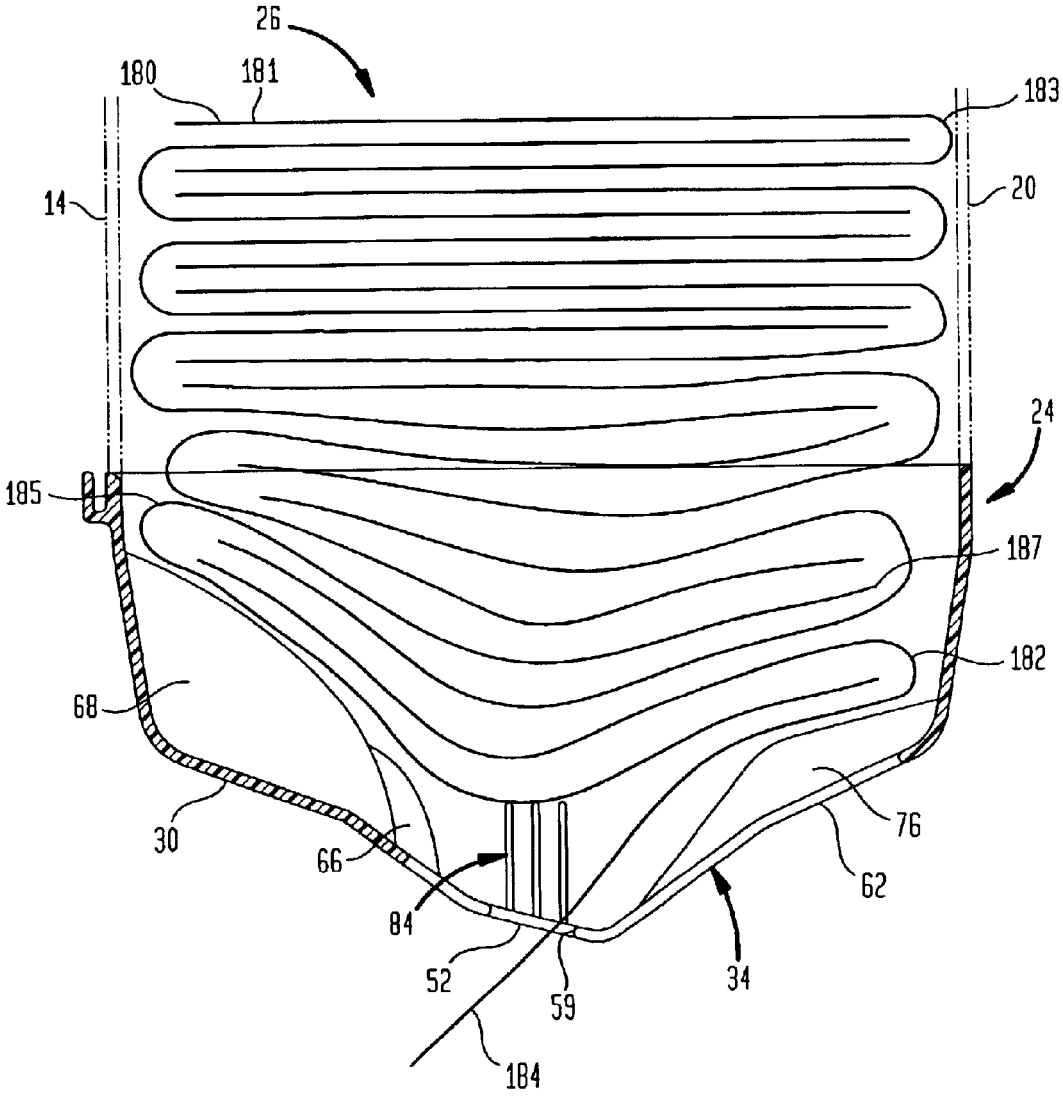
FIG. 11 is a schematic diagram illustrating the operation of the inventive dispenser.

The cooperation of the various guide ridges is perhaps better appreciated by reference to FIG. 11. In FIG. 11 there is shown in section the funnel portion of the inventive dispenser interacting with a single-fold napkin stack 26 as shown. The napkins are disposed in a dispenser such as dispenser 10 such that they rest in a substantially horizontal position in the dispenser housing as is shown at plane 180. As the napkins are drawn through the dispenser it can be seen that due to the fact that declivitous guide ridges such as ridge 68 are higher than their corresponding subsidiary guide ridges such as ridge 76, the napkins will assume an angle of inclination toward front wall 30 of the dispenser as shown in FIG. 11. That is to say, when stack 26 is placed in dispenser 10, the individual napkins in the stack generally reside horizontally in the housing such as in plane 180 where their front portions such as portion 181 are at the same elevation as their rearward portions such as portion 183. As one gets closer to the dispensing aperture, the napkins become inclined toward the front wall wherein their front portions, such as portion 185 are higher than their corresponding rearward portions such as portion 187. As will be appreciated by one of skill in the art, as a user withdraws a napkin such as napkin 182 by grasping its tail 184 and drawing it through aperture 52 the inter-folded leaves of the napkins along with the weight of the stack will urge subsequent napkins downwardly into conformity with the shape of the lower portion of the dispenser.

In general, the dispenser is sized such that it will accommodate a napkin with about ¼ inch clearance on each side of the dispenser; however, in the funnel portion of the dispenser the napkins will be forced to conform to the shape of the funnel portion as is shown for example in FIG. 11.

Transverse portion 62 generally must be of sufficient width so that a user may restart a stack of inter-folded napkins when the tail, such as tail 184 of the next napkin to be dispensed has not been drawn from the interior of the dispenser. Thus transverse portion 62 typically has a width 186 of from about 1½ to 2½ inches. A width 186 may be about 2 inches in a preferred embodiment.

Figure 6:
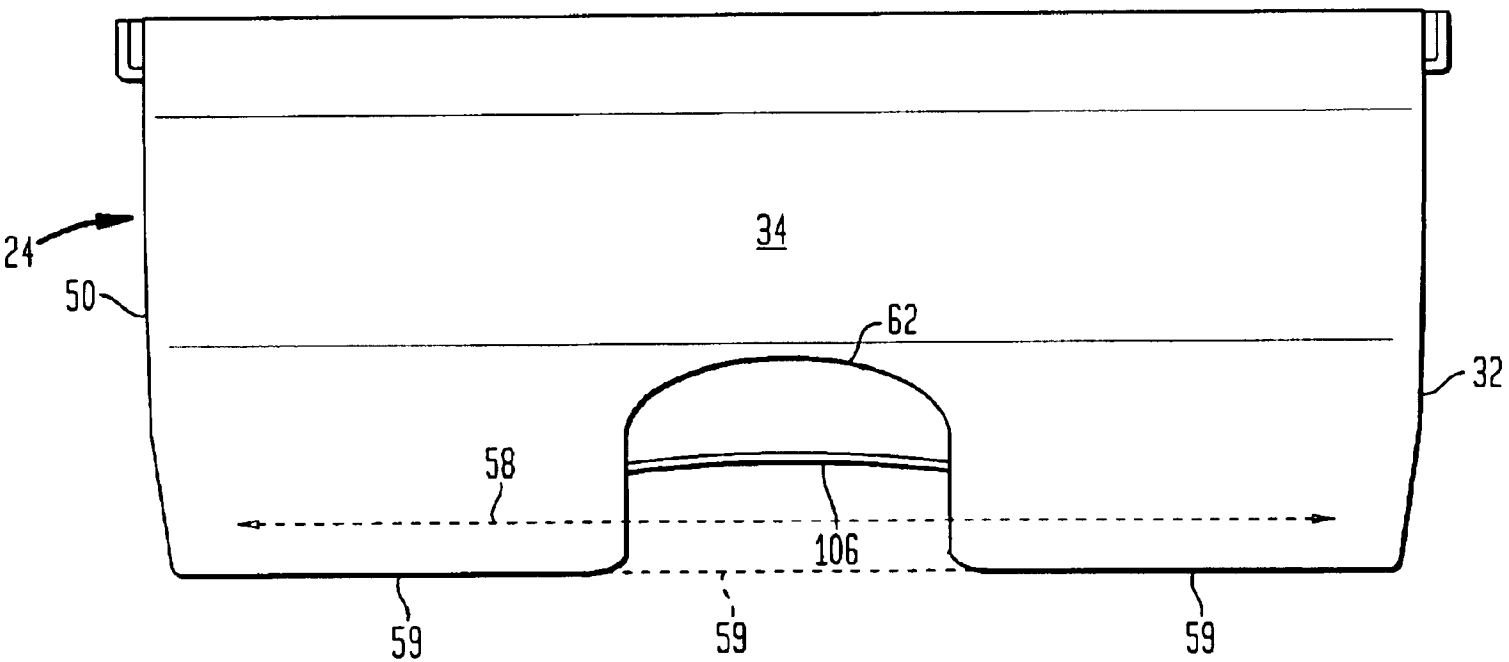
FIG. 6 is a view of the rear of the funnel portion of the napkin dispenser shown in FIG. 2.

Likewise, transverse portion 62 may extend upwardly a substantial distance from the bottom of the dispenser as is seen, for example, in FIG. 6. Distance 188 may be from about 3 to about 4 inches and is typically about 3½ inches. As will be appreciated from FIGS. 4 and 6 transverse portion 62 may extend upwardly in wall 34 about the central portion thereof.

While the inventive dispenser has been described in connection with a preferred embodiment, various modifications within the spirit and scope of the present invention, set forth in the appended claims, will be readily apparent to those of skill in the art.

What is claimed is:

1. A gravity-feed dispenser for a stack of folded absorbent sheets comprising:

(a) a generally rectangular housing provided with a front wall, a rear wall, two sidewalls and a lower portion;

(b) a funnel portion coupled to said lower portion of said housing provided with a generally convergent profile such that a front wall of said funnel portion extends downwardly and inwardly with respect to the front wall of said housing, a rear wall of said funnel portion extends downwardly and inwardly with respect to the rear wall of said housing and two sidewalls of said funnel portion extend downwardly substantially in alignment with the sidewalls of said housing;

(c) a dispensing aperture defined by said funnel portion of said dispenser, said aperture having an elongate portion extending substantially from one sidewall of said funnel portion to the other sidewall of said funnel portion thus defining an elongate axis of said aperture, the aperture having a rear border of the elongate portion of said aperture and wherein said aperture is configured so that the elongate portion thereof extends upwardly from its rear border to said front wall of said funnel portion of said dispenser such that folded absorbent sheets disposed in said funnel portion of said dispenser are exposed adjacent said front wall of said funnel portion of said dispenser over a substantial height from the rear border of the elongate portion of the aperture and are so presented at the front of said dispenser;

(d) a plurality of declivitous guide ridges disposed on an inner surface of said front wall of said funnel portion of said dispenser configured to guide folded absorbent sheets downwardly as they are drawn through said aperture of said dispenser;

(e) a plurality of subsidiary guide ridges disposed on an inner surface of said rear wall of said funnel portion of said dispenser configured to guide folded absorbent sheets downwardly as they are drawn through said aperture of said dispenser, wherein said plurality of declivitous guide ridges and said plurality of subsidiary guide ridges are positioned, configured and dimensioned to incline sheets of said stack in the vicinity of the dispensing aperture such that their front portions are elevated with respect to their rearward portions; and (f) a plurality of shelf members positioned at each of the terminal portions of the elongate portion of the aperture for supporting said stack of absorbent sheets within said dispenser wherein the shelf members have a substantially horizontal upper support surface.

2. The gravity-feed dispenser according to claim 1, wherein said dispensing aperture is provided with an arcuate front lip extending upwardly to a maximum height at its central portion.

3. The gravity-feed dispenser according to claim 1, wherein said stack of absorbent sheets comprises a stack of inter-folded napkins.

4. The gravity-feed dispenser according to claim 3, wherein said stack of inter-folded napkins has a dispensing length of up to about 10½ inches.

5. The gravity-feed dispenser according to claim 4, wherein said stack of inter-folded napkins has a dispensing length of up to about 7½ inches.

6. The gravity-feed dispenser according to claim 3, wherein said plurality of declivitous guide ridges disposed on said inner surface of said front wall of said funnel portion extend upwardly to a height greater than a height that said subsidiary guide ridges project upwardly from said rear wall of said funnel portion.

7. The gravity feed dispenser according to claim 3, wherein said plurality of declivitous guide ridges are provided with an arcuate profile.

8. The gravity-feed dispenser according to claim 3, wherein said plurality of subsidiary guide ridges are provided with a generally triangular profile.

9. The gravity-feed dispenser according to claim 6, wherein said plurality of declivitous guide ridges project upwardly from said front wall of said funnel portion to a maximum distance of from about ½ inch to about 1 inch.

10. The gravity-feed dispenser according to claim 9, wherein said plurality of declivitous guide ridges project upwardly from said front wall of said funnel portion to a maximum distance of about ¾ inch.

11. The gravity-feed dispenser according to claim 6, wherein said plurality of declivitous guide ridges include at least one centrally located declivitous guide ridge and at least a pair of laterally located declivitous guide ridges, said laterally located declivitous guide ridges being located between said centrally located declivitous guide ridge and a respective sidewall of the funnel portion of the dispenser, wherein said centrally located declivitous guide ridge projects upwardly to a height higher than that of said laterally located declivitous guide ridges.

12. The gravity-feed dispenser according to claim 11, wherein said plurality of declivitous guide ridges comprises at least 2 centrally located declivitous guide ridges between said laterally located declivitous guide ridges, each of which centrally located declivitous guide ridges projects upwardly to a height higher than that of said laterally located declivitous guide ridges.

13. The gravity-feed dispenser according to claim 6, wherein said subsidiary guide ridges project upwardly from said rear wall of said funnel portion to a maximum distance of from about ¼ inch to about ½ inch.

14. The gravity-feed dispenser according to claim 13, wherein said subsidiary guide ridges project upwardly from said rear wall of said funnel portion a maximum distance of about ⅜ inch.

15. The gravity-feed dispenser according to claim 3, wherein said shelf means comprises a plurality of generally rectangular projections projecting inwardly from the sidewalls of said funnel portion of said dispenser defining a shelf height above said elongate axis of said aperture.

16. The gravity-feed dispenser according to claim 3, wherein at least one of said declivitous guide ridges has a friction surface width of from about 40 to about 100 mils.

17. The gravity-feed dispenser according to claim 16, wherein at least one of said declivitous guide ridges has a friction surface width of from about 50 to about 70 mils.

18. The gravity-feed dispenser according to claim 3, wherein said plurality of declivitous guide ridges comprises from 2 to 8 declivitous guide ridges.

19. The gravity-feed dispenser according to claim 3, wherein said plurality of declivitous guide ridges comprises at least 4 declivitous guide ridges.

20. The gravity-feed dispenser according to claim 3, wherein at least one of said subsidiary guide ridges has a friction surface width of from about 40 to about 100 mils.

21. The gravity-feed dispenser according to claim 20, wherein at least one of said subsidiary guide ridges has a friction surface width of from about 50 to about 70 mils.

22. The gravity-feed dispenser according to claim 3, wherein said plurality of subsidiary guide ridges consists of from 2 to 8 subsidiary guide ridges.

23. The gravity-feed dispenser according to claim 3, wherein said plurality of subsidiary guide ridges comprises at least 4 subsidiary guide ridges.

24. The gravity-feed dispenser according to claim 3, wherein said stack of inter-folded napkins is a stack of single-fold inter-folded napkins disposed in the dispenser.

25. The gravity-feed dispenser according to claim 3, wherein said stack of inter-folded napkins is a stack of two-fold inter-folded napkins disposed in the dispenser.

26. The gravity-feed dispenser according to claim 25, wherein said stack of two-fold napkins is disposed in said dispenser and comprises a plurality of two-fold napkins, each of which has a lower tail portion projecting toward said front wall of said housing.

27. The gravity-feed dispenser according to claim 3, wherein said housing is provided with a plurality of inwardly projecting support members for frictionally supporting said stack.

28. The gravity-feed dispenser according to claim 3, wherein the length of said elongate axis of said dispensing aperture is from about 5 to about 20 percent less than the corresponding dispensing length of said stack of folded inter-folded napkins.

29. The gravity-feed dispenser according to claim 3, wherein the length of said elongate axis of said dispensing aperture is about 10 percent less than the corresponding dispensing length of said stack of folded inter-folded napkins.

30. A gravity-feed dispenser for a stack of folded absorbent sheets comprising:

(a) a generally rectangular housing provided with a front wall, a rear wall, two sidewalls and a lower portion;

(b) a funnel portion coupled to said lower portion of said housing provided with a generally convergent profile such that a front wall of said funnel portion extends downwardly and inwardly with respect to the front wall of said housing, a rear wall of said funnel portion extends downwardly and inwardly with respect to the rear wall of said housing and two sidewalls of said funnel portion extend downwardly substantially in alignment with the sidewalls of said housing;

(c) a dispensing aperture defined by said funnel portion of said dispenser, said aperture having an elongate portion extending substantially from one sidewall of said funnel portion to the other sidewall of said funnel portion thus defining an elongate axis of said aperture, the aperture having a rear border of the elongate portion of said aperture and wherein said aperture is configured so that the elongate portion thereof extends upwardly from its rear border to said front wall of said funnel portion of said dispenser such that folded absorbent sheets disposed in said funnel portion of said dispenser are exposed adjacent said front wall of said funnel portion of said dispenser over a substantial height from the rear border of the elongate portion of the aperture and are so presented at the front of said dispenser, the aperture further being provided with a transverse portion extending from the rear border of the elongate portion of said aperture upwardly in said rear wall of said funnel portion of said dispenser, said transverse portion of said aperture being configured to allow access to the interior of said funnel portion of said dispenser in order to withdraw absorbent sheet from said dispenser;

(d) a plurality of declivitous guide ridges disposed on an inner surface of said front wall of said funnel portion of said dispenser configured to guide folded absorbent sheets downwardly as they are drawn through said aperture of said dispenser;

(e) a plurality of subsidiary guide ridges disposed on an inner surface of said rear wall of said funnel portion of said dispenser configured to guide folded absorbent sheets downwardly as they are drawn through said aperture of said dispenser, wherein said plurality of declivitous guide ridges and said plurality of subsidiary guide ridges are positioned, configured and dimensioned to incline sheets of said stack in the vicinity of the dispensing aperture such that their front portions are elevated with respect to their rearward portions; and (f) shelf means positioned about the terminal portions of the elongate portion of the aperture for supporting said stack of absorbent sheets within said dispenser.

31. The gravity-feed dispenser according to claim 30, wherein said stack of folded absorbent sheets comprises a stack of inter-folded napkins.

32. The gravity-feed dispenser according to claim 31, wherein said transverse portion of said dispensing aperture has a width of from about 1½ to about 2½ inches.

33. The gravity-feed dispenser according to claim 32, wherein said transverse portion of said dispensing aperture has a width of about 2 inches.

34. The gravity-feed dispenser according to claim 33, wherein said transverse portion of said dispensing aperture has a length of from about 3 to about 4 inches.

35. The gravity-feed dispenser according to claim 34, wherein said transverse portion of said dispensing aperture has a length of about 3½ inches.

36. The gravity-feed dispenser according to claim 31 wherein said transverse portion of said dispensing aperture extends upwardly in a central portion of said rear wall of said funnel portion of said dispenser.

37. A method of dispensing a stack of inter-folded napkins comprising:

(a) disposing a stack of inter-folded napkins in a dispenser comprising:

(i) a generally rectangular housing provided with a front wall, a rear wall, two sidewalls and a lower portion;

(ii) a funnel portion coupled to said lower portion of said housing provided with a generally convergent profile such that a front wall of said funnel portion extends downwardly and inwardly with respect to the front wall of said housing, a rear wall of said funnel portion extends downwardly and inwardly with respect to the rear wall of said housing and two sidewalls of said funnel portion extend downwardly substantially in alignment with the sidewalls of said housing;

(iii) a dispensing aperture defined by said funnel portion of said dispenser, said aperture having an elongate portion extending substantially from one sidewall of said funnel portion to the other sidewall of said funnel portion thus defining an elongate axis thereof, the aperture having a rear border of the elongate portion of said aperture and wherein said aperture is configured so that the elongate portion thereof extends upwardly from its rear border to said front wall of said funnel portion of said dispenser such that folded absorbent sheets disposed in said funnel portion of said dispenser are exposed adjacent said front wall of said funnel portion of said dispenser over a substantial height from the rear border of the elongate portion of the aperture and are so presented at the front of said dispenser, the aperture further being provided with a transverse portion extending from the rear border of the elongate portion of said aperture upwardly in said rear wall of said funnel portion of said dispenser, said transverse portion of said aperture being configured to allow access to the interior of said funnel portion of said dispenser in order to withdraw absorbent sheet from said dispenser;

(iv) a plurality of declivitous guide ridges disposed on an inner surface of said front wall of said funnel portion of said dispenser configured to guide folded absorbent sheets downwardly as they are drawn through said aperture of said dispenser;

(v) a plurality of subsidiary guide ridges disposed on an inner surface of said rear wall of said funnel portion of said dispenser configured to guide folded absorbent sheets downwardly as they are drawn through said aperture of said dispenser, wherein said plurality of declivitous guide ridges and said plurality of subsidiary guide ridges are positioned, configured and dimensioned to incline sheets of said stack in the vicinity of the dispensing aperture such that their front portions are elevated with respect to their rearward portions; and (vi) shelf means positioned about the terminal portions of the elongate portion of the aperture for supporting said stack of absorbent sheets within said dispenser; and (b) withdrawing said napkins through said dispensing aperture.

38. The method according to claim 37, wherein said transverse portion of said dispensing aperture has a width of from about 1½ to about 2½ inches.

39. The method according to claim 38, wherein said transverse portion of said dispensing aperture has a width of about 2 inches.

40. The method according to claim 37, wherein said transverse portion of said dispensing aperture has a length of from about 3 to about 4 inches.

41. The method according to claim 40, wherein said transverse portion of said dispensing aperture has a length of about 3½ inches.

42. The method according to claim 37, wherein said transverse portion of said dispensing aperture extends upwardly in a central portion of said rear wall of said funnel portion of said dispenser.

43. The method according to claim 37, wherein said stack of inter-folded napkins comprises inter-folded single-fold napkins.

44. The method according to claim 37, wherein said stack of inter-folded napkins comprises inter-folded two-fold napkins.

45. The method according to claim 37, further comprising the step of preparing a stack of inter-folded napkins provided with an indicator identifying a front portion thereof and wherein said step of disposing said stack of inter-folded napkins in said dispenser comprises disposing said stack of inter-folded napkins in said dispenser with said front portion thereof disposed adjacent the front wall of said housing.

46. The method according to claim 45, wherein said stack of napkins comprises a plurality of two-fold napkins each of which has a lower tail portion projecting toward said front wall of said housing.

47. The method according to claim 37, wherein said stack of inter-folded napkins has a dispensing length of from about 5½ to about 7½ inches.

48. The method according to claim 37, wherein said stack of inter-folded napkins has a dispensing length of about 6½ inches.

49. The method according to claim 37, wherein said stack of inter-folded napkins has a dispensing length of up to about 10½ inches.

* * * * *

UNITED STATES PATENT AND TRADEMARK OFFICE

CERTIFICATE OF CORRECTION

PATENT NO. : 6,899,251 B2
APPLICATION NO. : 10/213575
DATED : May 31, 2005
INVENTOR(S) : James B. Christensen et al.

It is certified that error appears in the above-identified patent and that said Letters Patent is hereby corrected as shown below:

In Column 1, line 60, change “comers” to --corners--;
In Column 4, line 10, delete the second instance of “of”;
In Column 4, line 14, delete “T subsidiary” and insert --Subsidiary--;
In Column 7, line 38, delete “bout” and insert --about--;
In Column 8, lines 56 & 57, delete the second instance of “in the dispenser shown”;
In Column 10, line 58, change “gravity feed” to --gravity-feed--; and
In Column 13, line 19, change “31” to --31,--.

Signed and Sealed this

Eighth Day of August, 2006

JON W. DUDAS
*Director of the United States Patent and Trademark Office*